United States Patent [19]

Tenney et al.

[11] Patent Number: 4,781,329

[45] Date of Patent: Nov. 1, 1988

[54] COMBINED POWER DUSTER AND ULV AEROSOL GENERATOR

[75] Inventors: William L. Tenney, Crystal Bay; Larry D. Conner, Medicine Lake; Edmund P. Meehan, Mound, all of Minn.

[73] Assignee: London Fog, Inc., Long Lake, Minn.

[21] Appl. No.: 948,389

[22] Filed: Dec. 31, 1986

Related U.S. Application Data

[63] Continuation of Ser. No. 735,113, May 17, 1985, abandoned.

[51] Int. Cl.[4] ..... B05B 7/14

[52] U.S. Cl. ..... 239/305; 239/307; 239/325; 239/346; 239/351; 239/365; 239/600

[58] Field of Search ..... 239/302-305, 239/307, 325, 346, 351, 354, 365-370, 310, 318, 600; 220/354

[56] References Cited

U.S. PATENT DOCUMENTS

| | | | |
|---|---|---|---|
| 1,806,784 | 5/1931 | Breuer | 239/351 |
| 1,896,382 | 2/1933 | White | 239/307 |
| 2,595,317 | 5/1952 | White, Jr. | 239/303 |
| 2,920,579 | 1/1960 | Grimm | 239/310 |
| 2,968,441 | 1/1961 | Holcomb | 239/337 |
| 3,113,725 | 12/1963 | Packard et al. | 239/318 |
| 3,130,519 | 4/1964 | Mauget | 239/337 |
| 3,191,869 | 6/1965 | Gilmour | 239/318 |
| 3,205,176 | 9/1965 | Tenney | 252/359 |
| 3,632,046 | 1/1972 | Hengesbach | 239/354 |
| 3,797,747 | 3/1974 | Buzzi et al. | 239/318 |
| 3,917,168 | 11/1975 | Tenney | 239/13 |
| 4,033,511 | 7/1977 | Chamberlin | 239/351 |
| 4,159,804 | 7/1979 | Rigamonti | 239/346 |
| 4,222,525 | 9/1980 | Hildebrandt | 239/351 |
| 4,330,088 | 5/1982 | Koyama et al. | 239/346 |
| 4,369,777 | 1/1983 | Lwoff et al. | 239/346 |

FOREIGN PATENT DOCUMENTS

| | | | |
|---|---|---|---|
| 831868 | 1/1952 | Fed. Rep. of Germany | 239/367 |
| 2439086 | 4/1975 | Fed. Rep. of Germany | 239/303 |
| 1392929 | 2/1965 | France | 239/337 |
| 424658 | 5/1967 | Switzerland | 239/337 |

OTHER PUBLICATIONS

Brochure—Campbell Hausfeld—"Sand Blast Equipment" 9/1979.

Parts Catalog—Campbell Hausfeld—"Power Pal".

*Primary Examiner*—Andres Kashnikow

*Assistant Examiner*—Michael J. Forman

*Attorney, Agent, or Firm*—Burd, Bartz & Gutenkauf

[57] ABSTRACT

A portable dust or aerosol dispenser has a motor-driven air compressor operable to supply compressed air to a coiled hose. A hand-operated valve assembly connected to the hose is selectively attached to a duster unit or an aerosol unit. The duster unit has container storing dust and a nozzle connected to a siphon tube to carry dust from the container and discharge the dust, along with air, to a desired location. The aerosol unit has a container storing a liquid and a nozzle assembly connected to a siphon tube to draw liquid from the container, break up the liquid in small particles and discharge the particles with a stream of air to a desired location.

24 Claims, 7 Drawing Sheets

COMBINED POWER DUSTER AND ULV AEROSOL GENERATOR

This is a continuation of application Ser. No. 735,113, filed May 17, 1986, now abandoned.

FIELD OF INVENTION

The art to which the invention pertains is material dispensers. The dispensers operate to discharge dusts and aerosols to selected locations.

BACKGROUND OF INVENTION

Dust and aerosol formulations are used as disinfestants in pest control programs. It is an established practice to introduce dust and aerosol insecticides into confined spaces, such as wall voids, ceiling spaces, crawl areas and the like, and also into the atmosphere to control insect infestation. Aerosols are also used for odor control, disinfectants and other purposes. Dusts are also used for other purposes.

Power air dusters are used to dispense insecticide dust. The dusters have motor-driven air pumps and hand-operated nozzles which may be mounted on containers storing the dust. Dip tubes extend into the containers and are used to carry dust to the nozzles. The dust has a tendency to cake and clog the dip tubes or nozzles. The operators shake or rap the nozzles and containers to ensure continuous dust flow. When a nozzle is located in a confined space, it is not feasible to effectively shake the nozzle or container attached thereto. The dusting operation must be stopped to allow the operator to clear out the clogged nozzle and/or dip tube. Liquid materials, such as liquid insecticides and fungicides, are dispensed with applicators operable o direct aerosols to selected locations. An example of a machine used to dispense an aerosol insecticide into the atmosphere is disclosed by Tenney in U.S. Pat. No. 3,917,168. Liquid insecticide is forced from a tank by air pressure to a nozzle. The liquid insecticide is heated in the nozzle and discharged from the nozzle into the atmosphere. Air under pressure is discharged from the nozzle simultaneously with the liquid. The high velocity expanding air and liquid react with each other to break up the liquid into relatively small particles forming an aerosol. This machine is not usable to dispense dust.

SUMMARY OF INVENTION

The invention is directed to an apparatus for dispensing materials, such as dust and liquid insecticides into a desired location. The apparatus is a portable dispenser having a motor-driven air compressor for delivering air under pressure to a hand-manipulated valve assembly. The valve assembly is adapted to be selectively connected to a duster unit or aerosol generator unit. The apparatus has a table for accommodating the duster unit and aerosol generator unit. The table, along with the air compressor and motor, are mounted on a base. A cover releasably attached to the base encloses all of the operating structure of the dispenser. The cover has a carrying handle allowing the apparatus to be manually transported.

The duster unit has a container for storing the dust. A cap carrying a nozzle assembly is attached to the container. The nozzle assembly includes a suction or dip tube that extends into the container for carrying the dust to a restricted passage. A manually operated on-off valve is used to control the supply of dust to the restricted passage. The hand-operated valve assembly attachable to the nozzle means is operable to supply the nozzle means with air under pressure. A flexible air hose is connected to the air compressor and valve assembly to allow the operator to move the duster unit to a selected location. Air flow through the restricted passage establishes a suction pressure that draws the dust in the container up the tube into the passage. Air pressure can be introduced into the container to facilitate the movement of dust up the tube. The dust mixes with the air. A nozzle directs the mixed dust and air to the selected location.

An applicator tube assembly can be used with the duster unit to introduce dust through a small hole into a confined area. The applicator tube assembly has a transparent flexible section which allows the container to be shaken, oscillated or vibrated when the tip is confined in a small hole, in order to ensure the continuous flow of dust through the nozzle assembly.

The aerosol generator unit has a nozzle assembly that includes a suction tube extended into a container for storing the liquid. The aerosol generator unit has a body with passage means for receiving air under pressure from the hand-operated valve assembly. The air flows through an annular discharge opening toward a desired location. The air flows past a liquid opening so as to draw liquid up the tube into the flowing air. The liquid discharged from the nozzle is atomized by the high velocity expanding air into relatively small particles. The nozzle can be replaced with an applicator tube assembly to allow aerosol to be introduced through holes leading to confined areas.

IN THE DRAWING

DESCRIPTION OF PREFERRED EMBODIMENTS

Referring to FIGS. 1 to 4, there is shown a portable duster and aerosol dispenser indicated generally at 10 used to apply dust or liquid insecticides or the like to desired areas. Dispenser 10 is used as part of pest control programs for space dusting or aerosol spraying and also for injection into confined wall voids, ceilings, attics, ducts, and the like. Dispenser 10 is a hand portable power duster which can be quickly converted with minimum effort into a ULV aerosol generator with simple hand tools or by hand alone. The ULV aerosol comprises small droplets that minimize the problem of oil slicks and wetting of surfaces. In this context, a ULV aerosol may have a desirable volume mean droplet diameter of 10 to 15 microns.

Figure 1:
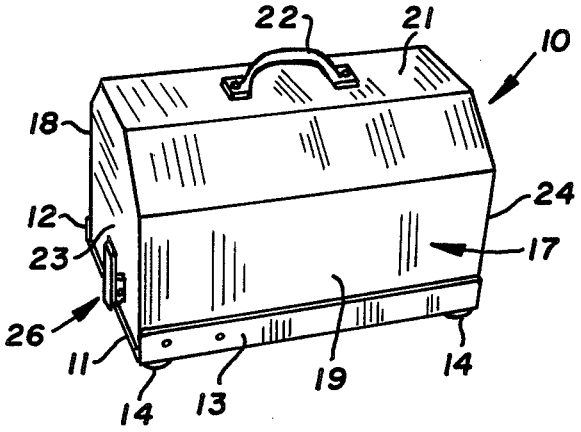
FIG. 1 is a perspective view of the dispenser of the invention.
Figure 2:
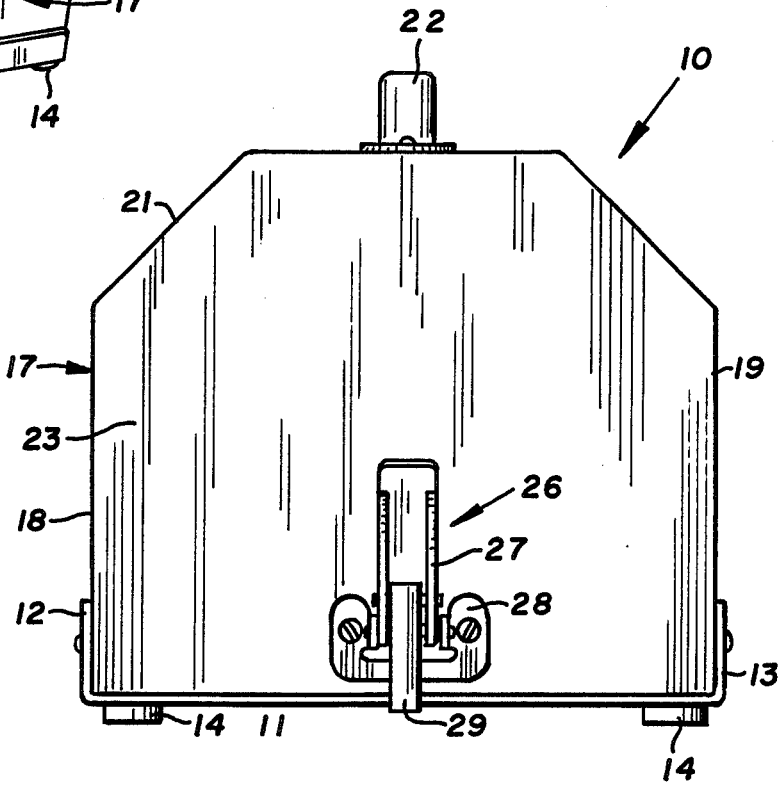
FIG. 2 is an enlarged end view of the dispenser of FIG. 1.
Figure 3:
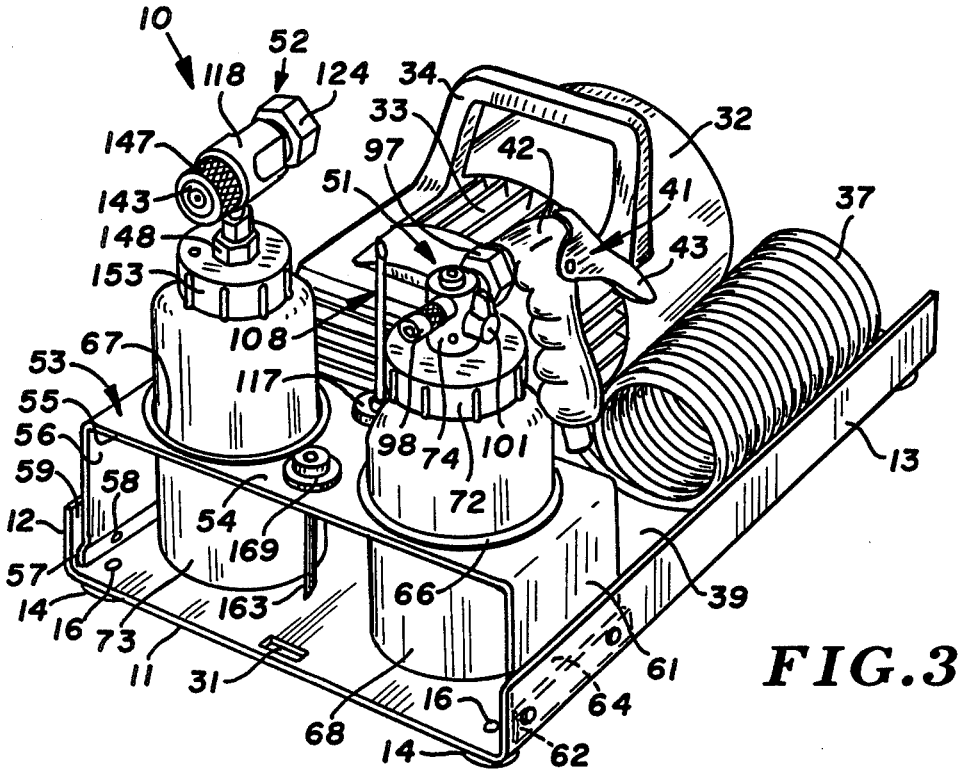
FIG. 3 is a perspective view of the dispenser with the carrying cover removed.

Dispenser 10 has a flat base 11 joined to upright side flanges 12 and 13. A plurality of cylindrical pads or feet 14 are secured to the corner portions of base 11 to support dispenser 10 on a surface, such as a floor. Screws 16 secure pads 14 to base 11. Base 11 cooperates with a cover 17 to form an enclosure for the operative parts of the dispenser, hereinafter described. Cover 17 has upright side walls 18 and 19 joined to a hip-shaped top 21. A handle 22, secured to the central section of top 21, is used to carry the entire dispenser. End walls 23 and 24 are joined to the opposite ends of side walls 18 and 19 of cover 21. As shown in FIG. 2, the lower portion of end wall 23 is located between side flanges 12 and 13 and in engagement with base 11. A latch, indicated generally at 26, releasably holds one end of cover 17 on base 11. A second latch (not shown) holds the other end of cover 17 on base 11. The latches are conventional over-center latch assemblies. Latch 26 is an over-center releasable connector having a first member 27 pivoted to a bracket 28. A second member or hook 29 is pivoted to first member 27. Member 29 has an end that fits into a slot 31 in the mid-portion of base 11, as seen in FIG. 3, when latch 26 is in the lock position. Latch 26 is released by moving member 27 in a downward direction thereby releasing hook 29 from slot 31. When the latches on end walls 23 and 24 are released, cover 17 can be lifted from base 11 to provide access to the operating components of dispenser 10.

Figures 4, 5, 6, 7, 13:
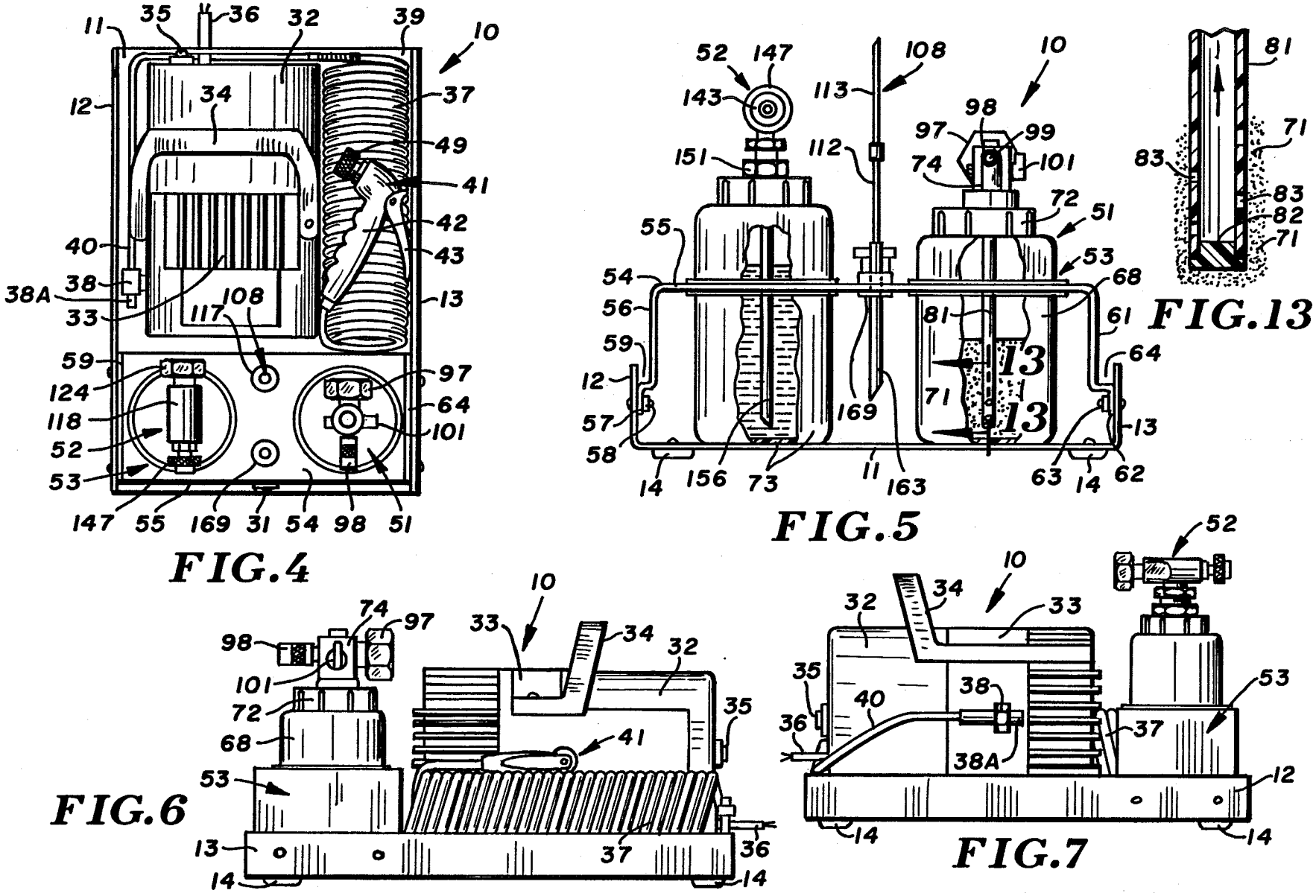
FIG. 4 is a top view of the dispenser with the carrying cover removed.
FIG. 5 is an enlarged end view of the left end of FIG. 3.
FIG. 6 is a side view of the right side of FIG. 4.
FIG. 7 is a side view of the left side of FIG. 4.
FIG. 13 is an enlarged sectional view taken along the line 13—13 of FIG. 5.

As shown in FIGS. 3 and 4, dispenser 10 has an electric motor 32 joined to an air compressor 33. Air compressor 33 is a conventional piston air compressor driven by electric motor 32. Motor 32 has a switch 35 operable to connect the motor to an electric power supply. An electrical cord 36, wired to motor 32, is used to connect motor 32 with a conventional electric service outlet. Fasteners (not shown), such as nut and bolt assemblies, secure motor 32 and air compressor 33 to base 11. An upwardly directed handle 34 is attached to air compressor 33 to facilitate the manual carrying of dispenser 10 without a cover 17.

Air compressor 33 is operable to deliver air under pressure to a flexible coiled air hose 37. A connector or T-coupling 38 having a pressure relief valve 38A and pipe 40 joins hose 37 to air compressor 33. Valve 38A functions to maintain the maximum air pressure into the coiled hose 37 at approximately 40 psi. Hose 37 is normally coiled and stored in a longitudinal space 39 adjacent motor 32 and air compressor 33. Side flange 13 retains coiled hose 37 in space 39.

Figure 8:
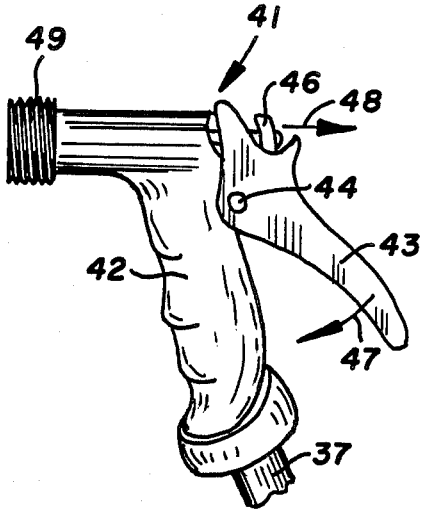
FIG. 8 is an enlarged side view of the manual valve assembly shown in FIG. 3.

Referring to FIGS. 3, 4 and 8, a manual valve assembly, indicated generally at 41, is connected to the outlet end of flexible coiled hose 37. Valve assembly 41 has a pistol grip or body 42. A lever 43 is pivoted at 44 to body 42. Lever 43 engages a linear movable valve actuator 46. When lever 43 is moved toward body 42, as indicated by the arrow 47, actuator 46 moves in an outward direction indicated by arrow 48. When actuator 46 is moved outwardly of body 42, the valve is opened allowing the air to flow through the valve assembly. A coil spring (not shown), located within body 42, biases the actuator 46 to a closed position. The outlet end of body 42 has a threaded male end 49 for selectively accommodating a duster unit indicated generally at 51 or an aerosol generator unit indicated generally at 52.

Referring to FIGS. 3', 4' and 5' duster unit 51 and aerosol generator unit 52 are retained on base 11 with a table indicated generally at 53. Table 53 has a flat top 54 having a transverse linear front side 55. A first side member or leg 56 extends downwardly from one end of top 54. The bottom of leg 56 has an outwardly and downwardly off-set lip 57. A plurality of fasteners 58 secure lip 57 to side flange 12. The lower portion of leg 56 is spaced inwardly from side flange 12 forming a longitudinal groove 59 for accommodating a portion of side wall 18 of cover 17. The opposite end of top 54 is joined to a downwardly directed second side member or leg 61. The lower portion of leg 61 terminates in an outwardly off-set lip 62. A plurality of fasteners 63 secure lip 52 to side flange 13. Leg 61 is spaced inwardly from side member 13 and forming a longitudinal groove 64. A lower portion of side wall 19 of cover 17 fits into groove 64. Top 54 has a first opening surrounded with a protective ring 66. A container 68 of duster unit 51 extends through ring 66 and is supported on base 11. Top 54 has a second protective ring 67 surrounding an opening accommodating a container 73 of aerosol generator unit 52. Container 73 extends through protective ring 67 and is supported on base 11. Protective rings 66 and 67 may be fabricated from plastic, rubber or other relatively soft, non-abrasive material Referring to FIGS. 9, 10, 11 and 13, there is shown the details of duster unit 51. Unit 51 has a body 74 mounted on the top of cap 72. Cap 72 has a cylindrical central hole 76 accommodating body 74. The lower end of body 74 has an outwardly directed annular flange that retains the body on top of cap 72. Body 74 has a plurality of air holes 77 and 78 allowing air to flow into container 68. Holes 77 and 78 also relieve any air pressure that may be supplied to container 68. A cylindrical sleeve 79 projects downwardly from the bottom of body 74. An elongated flexible dip or suction tube 81 is pressed tight into sleeve 79. As shown in FIG. 13, the bottom of tube 81 is closed with a plug 82 the lower portion of tube 81 has a plurality of small side holes 83 which allow the dust and like particulate material 71 to move into tube 81 in response to suction pressure within tube 81. The small side holes 83 prevent the plugging of the nozzle assembly with larger sized cakes of dust. Dust that cakes onto tube 81 can be dislodged by rapping sharply on the side of container 68 or shaking or oscillating it. Especially when the dust is damp, one or more air channels may be formed in the dust connecting holes 83 with the free surface of the dust in the container 68. The operator can rap, shake or oscillate the container 68 to close the air channels and thus continue the supply of dust into dip tube 81.

Figure 9:
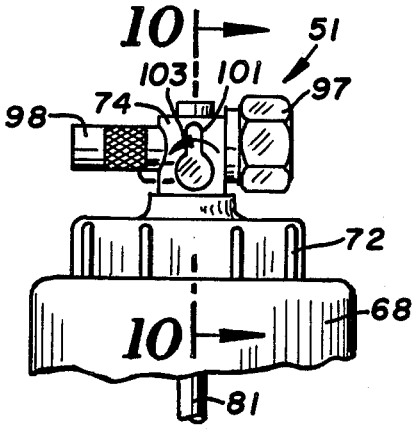
FIG. 9 is an enlarged side view of the top section of the duster unit of FIG. 3.
Figure 10:
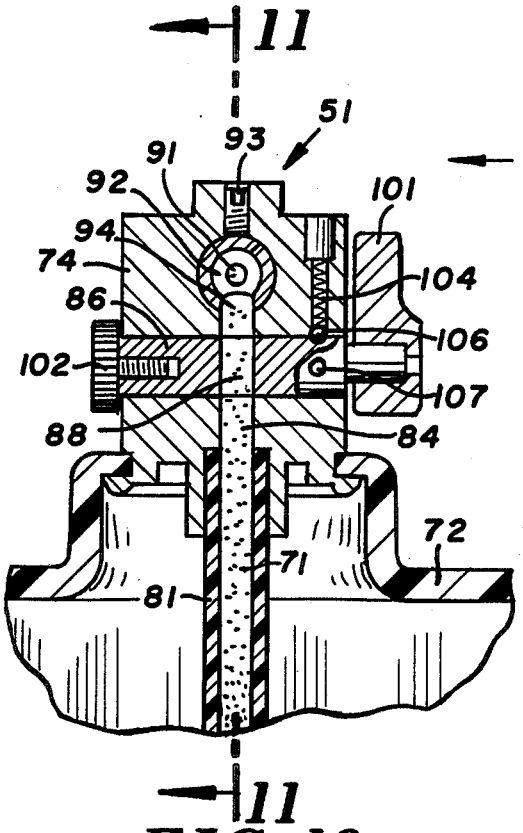
FIG. 10 is an enlarged section taken along the line 10—10 of FIG. 9.
Figure 11:
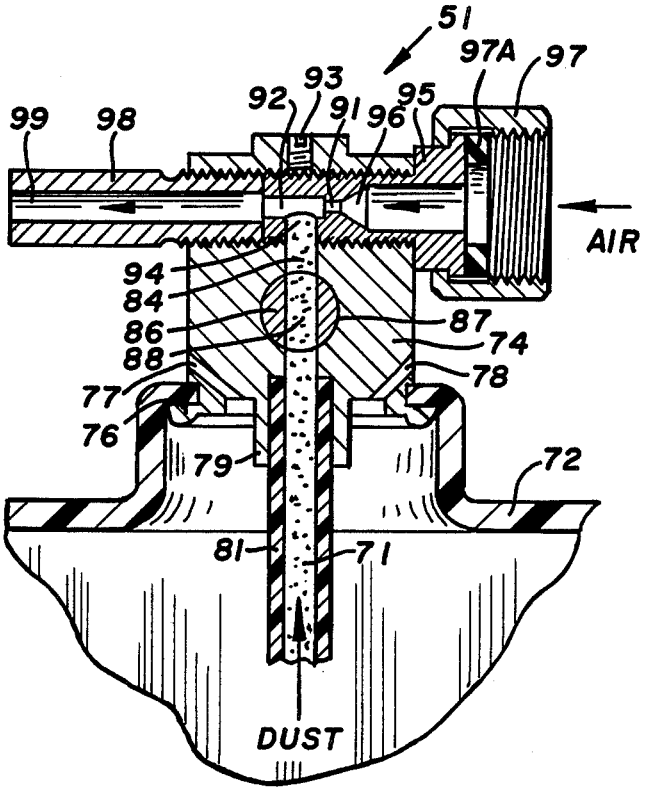
FIG. 11 is a sectional view taken along the line 11—11 of FIG. 10.

Returning to FIGS. 10 and 11, body 74 has an upright passage 84 aligned with tube 81. A transverse cylindrical valve 86 rotatably located in a bore 87 intersecting passage 84 is movable to open and closed positions to control the flow of air and dust through passage 84. Valve 86 has a passage 88 that is aligned with passage 84 when the valve is in the open position as shown in FIGS. 10 and 11. The upper end or port 94 of passage 84 intersects an outlet passage 92 located in a coupling 95. Coupling 95 is threaded into a bore in the upper end of body 74. A set screw 93 locks coupling 95 in place on body 74. Coupling 95 has a small hole 91 connecting outlet passage 92 with an inlet passage 96 to regulate the pressure of the air and velocity of air flowing into suction passage 92. A substitute coupling having a different diameter small hole 91 can be used in lieu of coupling 95 to change the concentration of the dust dispensed from duster unit 51. Valve 86 is attached to a manually operated knob 101 of a size and shape to be gripped by the fingers of a hand. A bolt 102, threaded into the end of valve 86 opposite knob 101, holds the valve 86 in rotatable assembled relation with body 74. As shown in FIG. 9, knob 101 is movable from an upright open position to a generally horizontal closed position as shown by arrow 103. Returning to FIG. 10, a ball detent 104 is selectively biased into recesses 106 and 107 in valve 86 to releasably hold valve 86 in either its open or closed positions.

A captive nut 97 rotatably mounted on coupling 95 is used to attach the threaded male end 49 of manually operated valve assembly 41 to duster unit 51. Nut 97 accommodates a gasket 97A to seal the coupling 95 to the valve assembly 41.

A nozzle or sleeve 98 having a linear central passage 99 is threaded into a bore in housing 74. Passage 99 is concentrically located relative to the small passage 92 in coupling 95. Nozzle 98 directs the air and dust entrained in the air to a desired location. In use, duster unit 51 is connected to the manually operated valve assembly 41 by turning nut 97 on the threaded male end 49 thereof. The entire duster unit 51 is supported on the manually operated valve assembly 41. The valve assembly 41 and dispensing unit can be hand moved to a desired location. The air is allowed to flow through dispensing unit 51 when lever 43 is pressed toward the body 42. This opens the valve in the manually operated valve assembly 41. The air flows through the small or restricted hole 91 and is discharged from the duster unit 51 through passage 99 in nozzle 98. Passage 99 confines the air into a generally linear stream of air that is introduced into the atmosphere. The air moving from the small hole 91 and through passage 92 passes port 94. This creates a suction force in passage 84 and tube 81. Dust 71 in container 68 is drawn up tube passage 84 and flows into passage 92 and mixed with the air flowing through passage 9. The flow of dust in passage 84 is controlled by the manually operated valve 86. When the valve 86 is in the open position as shown in FIGS. 10 and 11, the dust is free to flow through passage 84 into the suction passage 92 in coupling 95. The operator of the duster unit can turn valve 86 to its closed position by moving the knob 101 to a generally horizontal position. The ball detent 104 will hold the valve 86 in the closed position so that only air is discharged through nozzle 98. Thus, valve assembly 41 and nozzle 98 is usable as an air gun. The flow of air through coupling 95 can be regulated by replacing the coupling with a coupling having a different size hole 91. Dust 71 is drawn into the lower end of the suction tube 81 through the small holes 83. Any dust that cakes and accumulates on tube 81 and blocks small holes 83 can be separated from the tube by shaking or rapping container 68.

Figure 12:
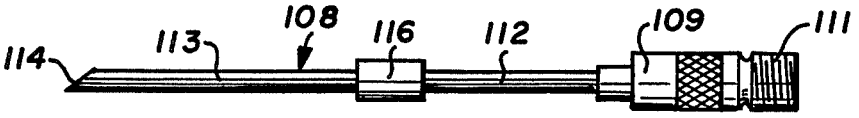
FIG. 12 is a plan view of an alternate duster nozzle for the duster unit of FIG. 9.

Referring to FIG. 12, there is shown an applicator tube assembly indicated generally at 108. Tube assembly 108 can replace nozzle 98 in duster unit 51. Tube assembly 108 has a tubular member or sleeve 109 having a threaded end 111. The threaded end 111 is adapted to be threaded into housing 74 in lieu of nozzle 98. A flexible transparent first tube 112 is joined to tubular member 109. A second rigid tube 113 is connected with sleeve connector 116 to the outer end of transparent tube 112. Tube 113 terminates in a beveled end or outlet 114. Beveled end 114 when transversely abutting a surface does not shut off the flow of dust and air to the desired location. Flexible tube 112 allows the rigid tube 113 to be moved to selected angles to allow the application of the dust to remote areas. Flexible tube 112 also allows duster unit 51 to be vibrated, shaken or oscillated to shake up the dust in container 68 when the rigid tube is located in a confined area, such as a hole in a structure. The flow of the dust may be visually monitored through transparent tube 112.

As shown in FIGS. 3 and 4, top wall 54 has a first holding ring 117 selectively accommodating and storing nozzle 98 or applicator tube assembly 108. Ring 117 holds the nozzle 98 or applicator tube assembly 108 in a generally upright position.

Figure 14:
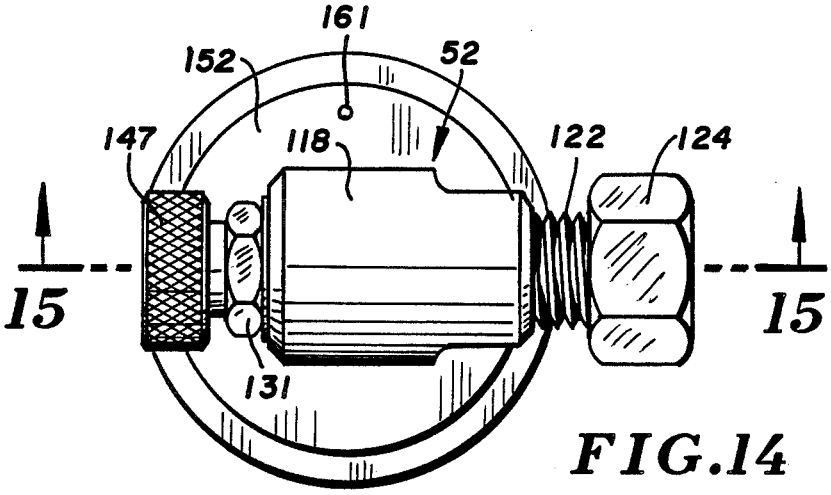
FIG. 14 is an enlarged top view of the aerosol generator unit of FIG. 3.
Figure 15:
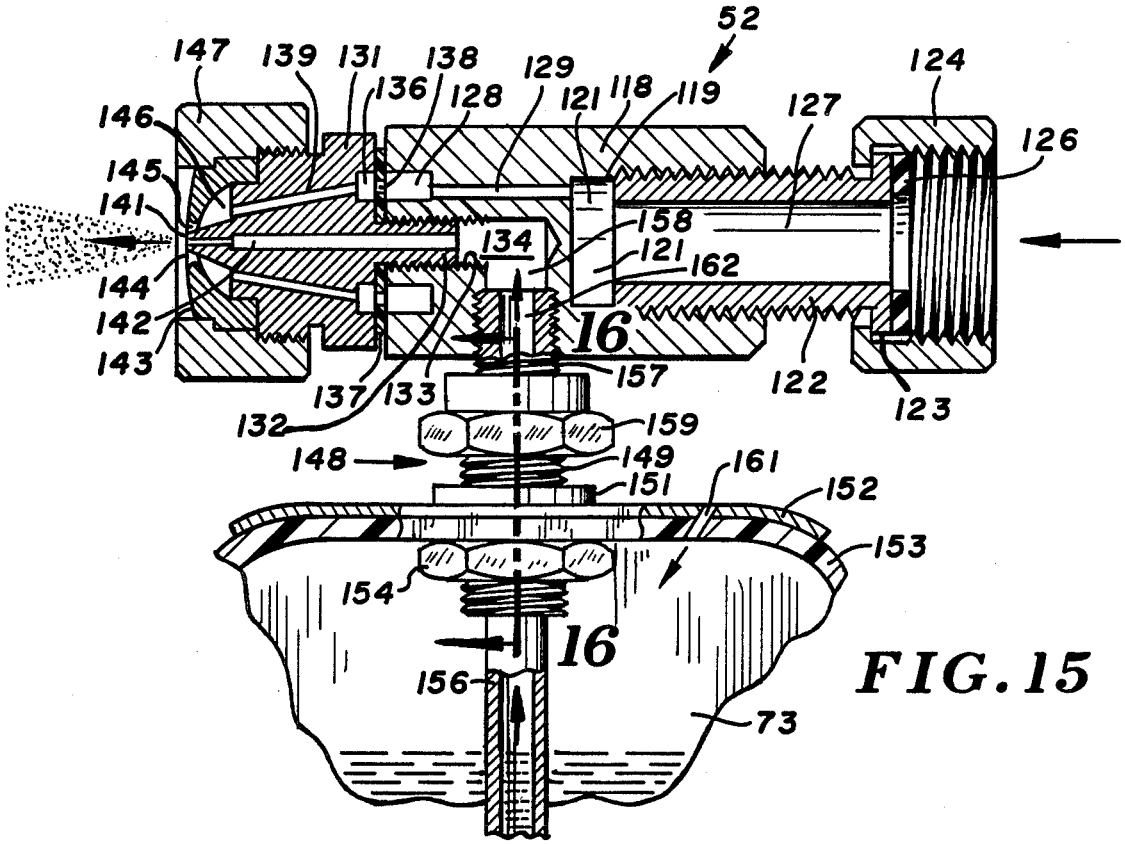
FIG. 15 is an enlarged sectional view taken along the line 15—15 of FIG. 14.

Referring to FIGS. 14 and 15, there is shown the details of the aerosol generator unit 52. Unit 52 has a body 118 having a longitudinal bore 119 providing a first chamber 121. A nipple 122 threaded into bore 119 has an outer outwardly directed lip 123 cooperating with a captive nut 124. The threaded male end 49 of the manually operated valve assembly 41 is adapted to be attached to nut 124. A gasket 126 located within nut 124 insures an air seal between nipple 122 and threaded male end 49. Nipple 122 has a longitudinal passage 127 connected to an annular chamber 128 by a plurality of holes or passages 129. A nozzle unit 131 mounted on the end of body 118 has an annular chamber 136 facing chamber 128. Nozzle unit 131 has a threaded projection 132 located within a threaded bore 133 in body 118. Bore 133 has an internal second chamber 134 open to a longitudinal passage 142 in nozzle unit 131. A thin gasket 137 having a plurality of holes 138 is interposed between body 118 and nozzle unit 131. Holes 138 provide air communication between annular chambers 128 and 136. Nozzle unit 131 has a plurality of bores or holes 139 connecting chamber 136 to the outer face thereof adjacent an outwardly directed conical nose 141. Nose 141 contains the restricted outer end of passage 142.

An annular cap 143 is mounted on nozzle assembly 131 surrounding nose 141. Cap 143 has a center opening 144 that surrounds and is spaced from the outer end of nose 141 providing an annular discharge opening 145 for air under pressure. The annular opening 145 is larger than and surrounds the outer end of nose 141. A ring nut 147 surrounding cap 143 is threaded onto nozzle assembly 131 to hold cap 143 in assembled relation with nozzle assembly 131. Cap 143 forms with nose 141 an annular chamber 146 for receiving air under pressure from holes 139 and dispersing the air through annular discharge opening 145.

Figure 16:
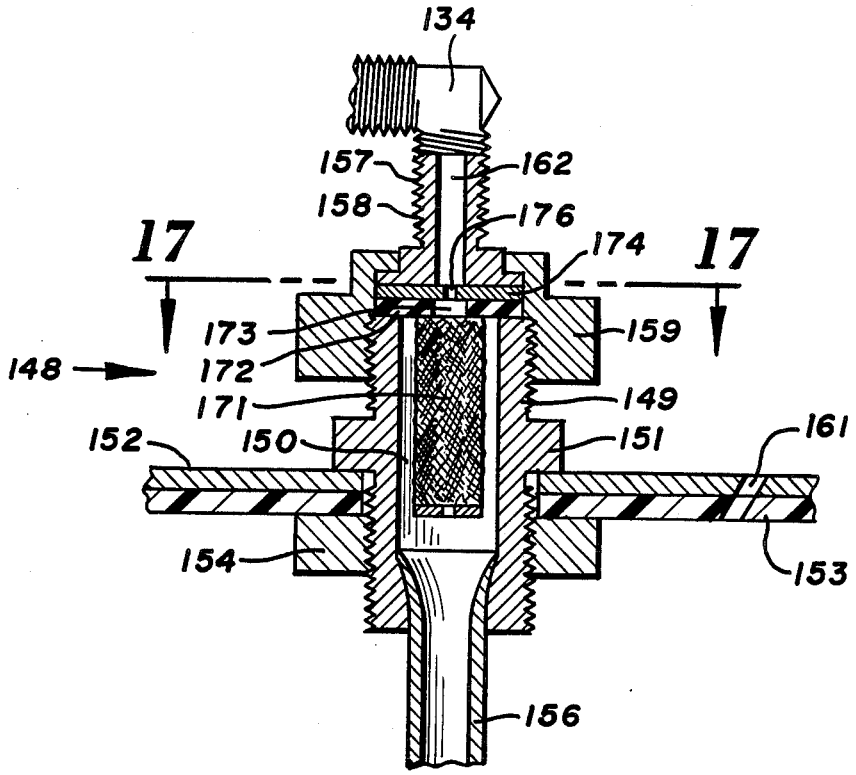
FIG. 16 is an enlarged sectional view taken along line 16—16 of FIG. 15.

As shown in FIGS. 15 and 16, a coupling indicated generally at 148 connects body 118 to cap 153 of container 73. Coupling 148 has a tubular nipple 149 and an enlarged flange 151. A nut 154 is threaded on the lower end of body 149 to secure body 149 to cover 153. A metal reinforcing disc 152 is located on top of cover 153. Disc 152 and cover 153 have a small hole 161 to allow air to flow into container 73. Hole 161 also relieves any air pressure that may be supplied to container 73. A suction tube 156 is secured to the lower inside end of body 149. Tube 156 extends downwardly and terminates in an open end adjacent the bottom of container 73. A tubular member 157 is threaded into a bore 158 open to chamber 134. A nut 159, cooperating with tubular member 157, is threaded onto body 149 to connect tubular member 157 to body 149. Tubular member 157 has a passage 162 providing fluid communication between body 149 and chamber 134. Body 149 has a passage 150 connecting the passage of tube 156 to passage 162 in tubular member 157. A filter 171 is located in passage 150 for collecting particles in the fluid flowing to nozzle 52 to minimize plugging of the nozzle. Filter 171 is a cylindrical screen attached to a head 172. Head 172 has a hole 173 allowing fluid to flow from the space within the screen to passage 162. A disc 174 having a metering orifice or hole 176 is located on top of head 172. Nut 159 holds head 172 and disc 174 on top of body 149. Discs having different sized orifices can be used to control the rate of fluid flowing into chamber 134. Metering disc 174 is used to facilitate the determination of the recommended amount of insecticide dispensed per 1000 cubic feet of space. The flow of fluid is regulated in fluid ounces per minute with the air pressure supplied to nozzle 52 at 40 psi.

Figure 18:
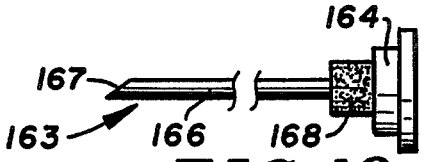
FIG. 18 is a plan view of an alternate aerosol tip for the aerosol unit as shown in FIG. 14.

Referring to FIG. 18, there is shown an alternate cap for the aerosol generator unit 52. The cap is a void tip indicated generally at 163. Tip 163 has an annular cap 164 that is identical in shape and size to cap 143. Cap 164 is adapted to fit onto the outer end of nozzle unit 131 and is retained thereon by ring nut 147. An elongated rigid tube 166 extended longitudinally from the center of cap 164 terminates in a beveled open end 167. The beveled open end 167 when transversely abutting a surface does not shut off the flow of aerosol to the desired location. The bevel at end 167 also reduces any accumulation of liquid droplets that might flow back along the outside of tube 166. A sponge collar 168 is disposed about tube 166 adjacent cap 164. Collar 168 functions as a sponge to absorb any liquid that might flow back along tube 166. The tip 163 can be projected through a hole in a structure so that the aerosol can be introduced within the interior of the structure. Top wall 54 of table 53 has a second ring 169 for alternatively storing tip 163 or cap 145.

Aerosol generator unit 52 is connected to the manually operated valve assembly 41 with nut 124. When the lever 43 is moved toward body 42, the valve in the valve assembly 41 allows the air to flow into the passage 127 of nipple 122. The air flows through the nozzle body 118 via the holes 129 into the annular passage 128. The air flows through gasket 137 via holes 138 into the annular passage 136 in the nozzle unit 131. Passages 139 deliver air under pressure to the chamber 146 surrounding nose 141. The air is discharged as an annular stream of air into the atmosphere via the annular discharge opening of 145 surrounding the end of nose 141. The liquid in the container 73 is drawn up the suction tube 156 into chamber 134 of body 118 by air rapidly moving past nose 141 which serves to draw the liquid through passage 142. The liquid is introduced into the rapidly moving and expanding air which causes the liquid moving out of nose 141 to break up into small particles which mix with the air forming a ULV aerosol which is dispensed into a desired location Referring to FIGS. 19 to 22, there is shown a modification of the duster unit of the invention indicated generally at 200 for introducing dust through smaller holes in a structure. Duster unit 200 has a container 201 having an internal chamber 202 for accommodating dust 203. Container 201 is made of a rigid material, such as metal of sufficient strength, to safely accommodate air under pressure of at least 40 psi. Container 201 has a top 204 accommodating a cap 206. An annular ring seal 207 is interposed between cap 206 and the annular upper end of top 204. Top 204 and cap 206 have interengaging threads which allow cap 206 to be removed from container 201.

Cap 206 has an upwardly directed cylindrical projection 208 surrounding a sleeve 210 and nipple 210A. A tube 209 extends downwardly through a longitudinal passage 211 in sleeve 210 and nipple 210A terminating adjacent the bottom of container chamber 202. Tube 209 has a threaded upper end 209A threaded into an upright bore 220. A lock nut 212 threaded on sleeve 210 holds cap 206 on body 214.

A dust dispensing gun indicated generally at 213 is thus mounted on top of projection 208. Gun 213 has a body 214 joined to a downwardly directed handle 216. The outlet end of body 214 has an upright bore 217 accommodating a threaded end 218 of nipple 210A. Body 214 has a second bore 220 concentric with bore 217 accommodating the upper end 209A of tube 209 that extends through passage 211 of nipple 210A. Alternatively, body 214 can have a threaded boss turned into the top of projection 208.

Handle 216 has an air inlet passage 219 leading to a passage 221 in body 24. An insert 223 having a small or restricted passage 224 is threaded into the outlet end of passage 221. Insert 223 has an outlet end located in an outlet or mixing chamber 222 that is in communication with bore 217. A nozzle assembly indicated generally at 226 is threadably mounted on body 214 to close chamber 222.

Body 214 has a second air passage 277 in communication with a passage 228 in projection 208. Passage 228 has an outlet opening 230 leading to chamber 202 of container 201. A plug 229 closes the outer end of passage 227. The passages 227 and 128 carry air under pressure from the main air passage 219 into chamber 202 to subject the dust in chamber 202 to air pressure.

A manually operated control valve indicated generally at 231 is mounted on handle 216. Handle 216 has a boss 232 having a bore 233. A downwardly open passage 234 is open to the bottom of handle 216. A valving member or spool 236 is slidably located in bore 233. A spring 237 engages spool 236 to hold spool 236 in a normally closed position. A bushing 238 threaded into bore 233 retains spool 236 in bore 233 and acts as a stop for spool 236. Spool 236 has a transverse passage 239 joined to a longitudinal bleed passage 241. The bleed passage is open to atmosphere at a head 242. When head 242 is moved in an inward direction as indicated by arrow 243 against the biasing force spring 237, the transverse passage 239 is moved into alignment with main air passage 219 to allow air to flow into container chamber 202 and through the restricted passage 224 into outlet chamber 222. Dust and air is mixed in chamber 222. The mixture of air and dust flow through the nozzle assembly 226 to the desired location. The finger of the operator closes the bleed passage 241. Other types of manually operated spool valves can be used to control the flow of air through the gun.

Figure 20:
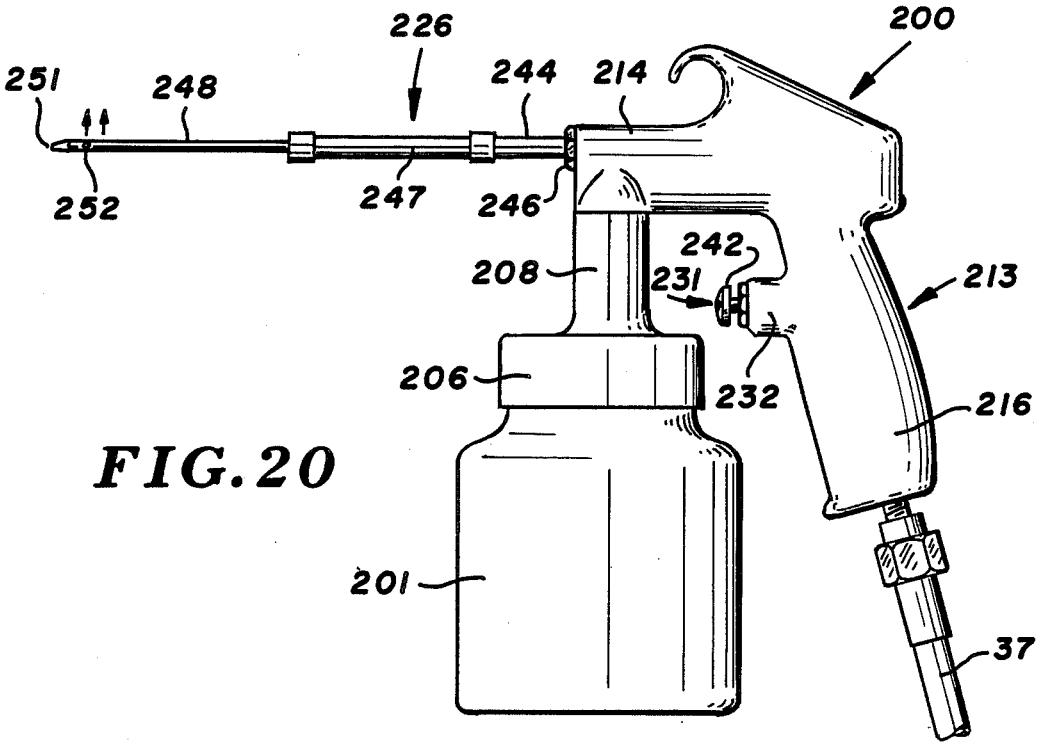
FIG. 20 is a side elevational view of the duster unit of FIG. 19.
Figure 22:
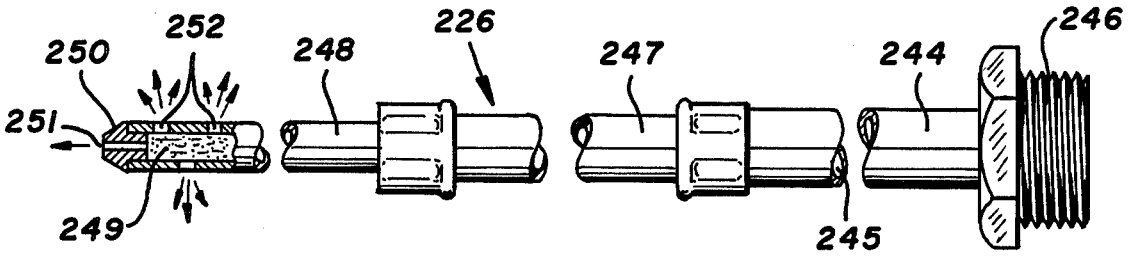
FIG. 22 is a foreshortened plan view, partly sectioned, of the duster nozzle for the duster unit of FIG. 19.
Figure 21:
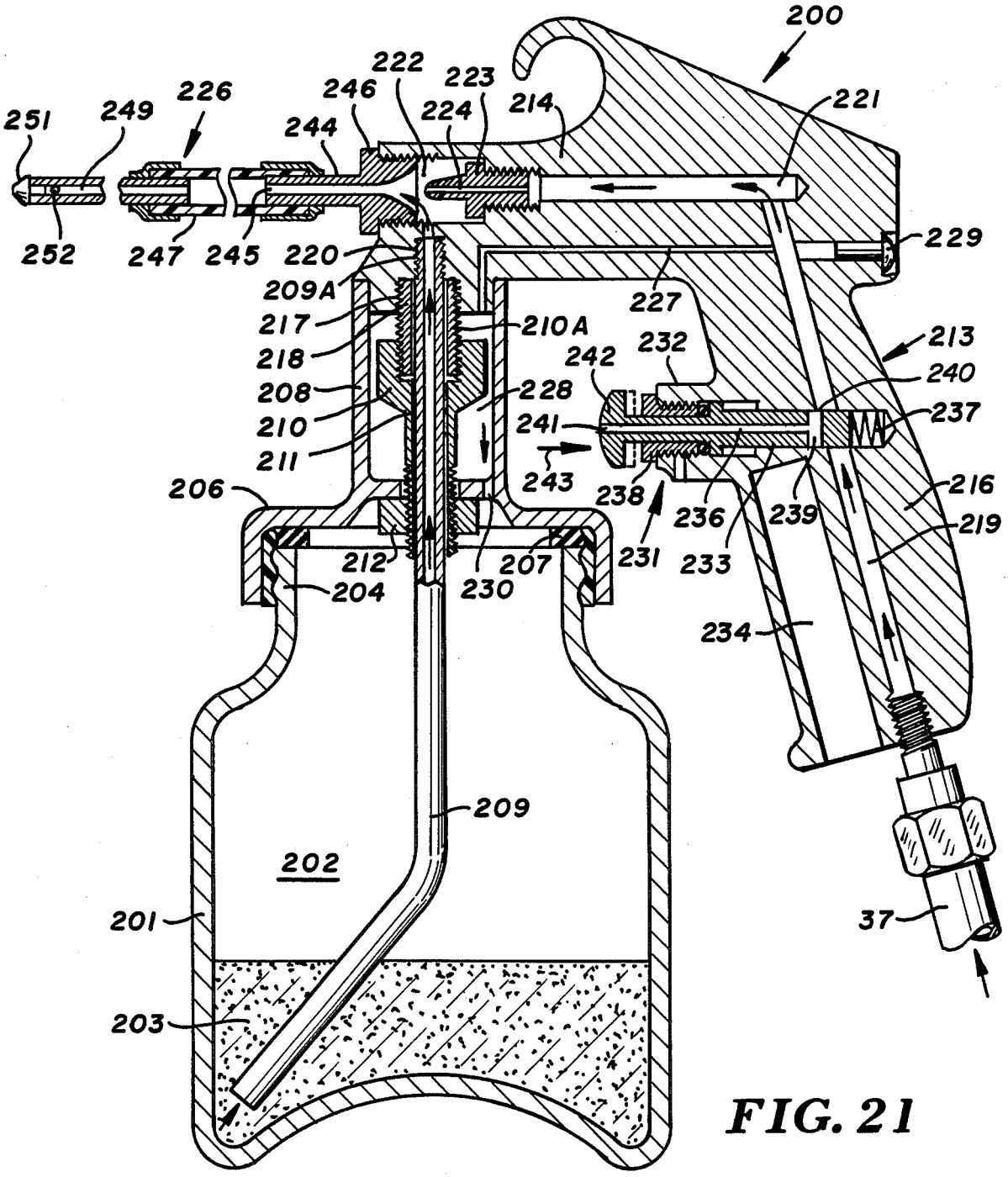
FIG. 21 is an enlarged sectional view taken along the line 21—21 of FIG. 19.

Referring to FIGS. 20 and 22, nozzle assembly 226 is an applicator tube unit having a tubular body 224 with a longitudinal passage 245 and a head 246. Head 246 is threaded into body 214 to attach the nozzle assembly 226 to the body. An elongated flexible transparent tube 247 is clamped unto the outer end of tubular body 244. Tub 247 receives a rigid probe 248 having a longitudinal passage 249. An end plug 250 closes the outer end of passage 249. Plug 250 may have a hole 251 to allow dust air to be discharged therefrom. Probe 248 is provided with a plurality of holes 252 adjacent plug 250 to allow the dust to be laterally dispensed from the probe 248. The flexible tube 247 facilitates the insertion of probe 248 into a remotely located small hole in a structure. In addition, flexible tube 249 allows dispensing gun 213 and container 201 20 to be moved, rapped or shaken to eliminate air tracks in the dust in chamber 202. Nozzle assembly 226 may also be made without end plug 250 and/or side holes 252.

Figure 17:
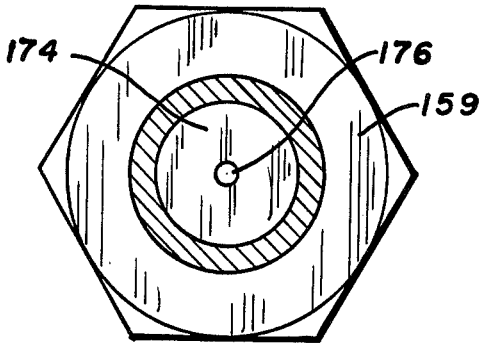
FIG. 17 is a sectional view taken along line 17—17 of FIG. 16.
Figure 19:
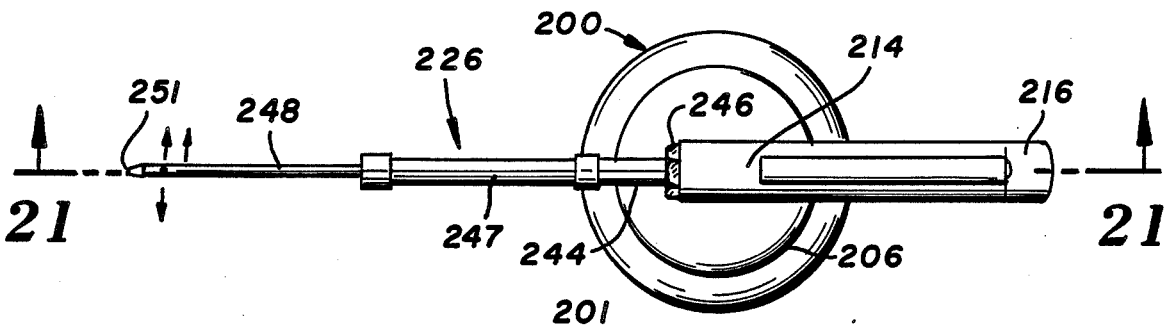
FIG. 19 is a modification of the duster unit.

In use, coil hose 37, carrying the air under pressure from the air compressor, is connected to the end of handle 216 as shown in FIG. 19. Control valve 231 is normally in the closed position. This prevents the air from being introduced into container chamber 202 and discharged into nozzle assembly 226. Control valve 231 is moved to the open position by applying digital pressure to head 242. This aligns the passage 239 with main air passage 219. The air under pressure flows through passages 219 and 221. The velocity of the air is increased as it flows through restricted passage 224 in insert 223. The high velocity air is directed into the inlet end of the passage 245 of tubular body 244. This creates a suction or vacuum force in outlet suction chamber 222. The suction draws dust up tube 209 and through sleeve 211 into suction chamber 222. The air moving through chamber 222 mixes with the dust and carries the dust through nozzle assembly 226. The dust 203 is discharged laterally from the outer end of probe 248 through holes 252 as indicated by the arrows in FIGS. 17, 18 and 20. The end of probe 248 can abut against a surface without interfering with the dispensing of the dust through side holes 252. Dust may also be discharged through hole 251 when such a hole is provided.

Air under pressure is also supplied to container chamber 202 via passages 227 and 228 and hole 230. The air pressure in chamber 202 forces dust 203 to move up tube 209 and through sleeve 211 into outlet chamber 222. The suction created by air moving through chamber 222 also draws dust into chamber 222. The air and dust in the chamber mix and flow through nozzle assembly 226. The flexible tube 247 facilitates the insertion of probe 248 into a confined hole and allows the gun and container to be shaken, rapped, vibrated and moved to agitate and loosen the dust 208 in chamber 202 with the probe inserted into the small hole. The hole can thus be made as small as the diameter of the probe 248.

When the force on the head 242 is released, spring 237 moves the spool 236 back to its closed position. Passage 239 has a small opening 240 in communication with the upper portion of passage 219. This allows the air under pressure in container 202 to bleed back through the bleed passage 241 to the atmosphere. This releases the air pressure in container chamber 202.

A principal object of the modified duster unit 200 is to permit use of a smaller diameter tube 248 and/or end plug 250 and small diameter side holes 252 With the nozzle assembly outlet thus restricted, it is no longer feasible to move the dust from container to the nozzle by suction only. Hence, with this modified construction, air under compressor outlet pressure is applied inside the container to aid in moving the dust from the container to and through the nozzle. A principal advantage of this structure results from being able to insert probe 248 through smaller holes and also laterally disperse the dust via side holes 252. Duster unit 200 is more costly, however, since container 201 must be of strong, preferably metal construction, in order to withstand safely the internal air pressure to which it is subjected. By contrast, container 68 of duster 51, shown in FIGS. 3 and 5, is not pressurized at compressor outlet pressure and thus can safely be made of lightweight, low cost, plastic material or the like.

While there has been shown and described several embodiments of the portable duster and aerosol dispenser, it is understood that changes in the structures and arrangement of the structure may be made by those skilled in the art without departing from the invention. The invention is defined in the following claims.

We claim:

1. An apparatus for dispensing material comprising:

a base, having opposite sides and generally upright side flanges joined to the opposite sides thereof, an air compressor mounted on the base, a pressure relief valve connected to the air compressor to control the maximum air pressure, a motor mounted on the base drivably connected to the air compressor, hose means connected to the air compressor to carry compressed air, manually operated valve assembly connected to the hose means selectively operable to block the flow of air and allow air to flow through the valve assembly, a table secured to the base, and material dispenser means removable associated with the table, said dispenser means having a container with a chamber for storing material, said container having an open top, cap means mounted on the container closing the open top, nozzle means having a first passage open to a material discharge opening, means for connecting the valve assembly to the nozzle means to supply air under pressure to the first passage, tube means extended into the chamber for carrying material stored therein, means mounted on the cap means having a second passage open to the first passage and connected to the tube means for carrying material from the tube means when air flows through the first passage, said material in the chamber moves up the tube means, flows through the second passage into the first passage, and is discharged through the discharge opening to a desired location, valve means operatively associated with the means mounted on the cap means operable to selectively open and close the second passage to allow material to flow through the second passage into the first passage and stop the flow of material through the second passage, said table having downwardly directed side members secured to the side flanges, said side members being laterally spaced from the side flanges forming grooves, cover means for enclosing the air compressor, motor, air hose, valve assembly, table, and dispenser means, said cover means having side walls extended into said grooves, and latch means releasably connecting the cover means to the base.

2. The apparatus of claim 1 wherein: said table has a generally flat top wall and downwardly directed side members locating the top wall above the base, said top wall having means for accommodating the dispenser means.

3. The apparatus of claim 2 wherein: the means for accommodating the dispenser means comprises an opening in the top wall for the container, said container extended through the opening and supported on the base.

4. The apparatus of claim 1 wherein: said dispenser means comprises a first dispenser unit having a first container and a second dispenser unit having a second container, said table means having a top wall with a first opening for the first container and a second opening for the second container, said first and second containers being supported on the base.

5. The apparatus of claim 1 wherein: the air compressor and motor are laterally spaced from one side of the base providing a storage area for the hose means, said hose means being normally coiled when located in the storage area.

6. The apparatus of claim 1 wherein: the means mounted on the cap means comprises a body having the second passage, a bore in said body intersecting said second passage, said valve means including a valving member located in said bore having a passage aligned with the second passage to allow material to flow through the second passage, said valving member being movable to a position to block the flow of material through the second passage.

7. The apparatus of claim 1 wherein: said nozzle means has sleeve means having an air and material discharge opening.

8. The apparatus of claim 1 including: an applicator tube assembly mounted on the nozzle means to carry the air and material toward a desired location, said tube assembly having a material discharge end and a flexible portion whereby the nozzle means and container can be moved relative to the discharge end of the tube assembly.

9. The apparatus of claim 1 wherein: said nozzle means has a body, a coupling having said first passage mounted on the body, a sleeve having a throat passage mounted on the coupling, said throat passage aligned with the first passage to carry air through the nozzle means, said body having the second passage, said second passage being open to said throat passage whereby air flowing through the throat passage draws material up the tube means and through the second passage into the throat passage, said material mixing with the air discharged from the nozzle means.

10. The apparatus of claim 9 wherein: said body has a bore intersecting the second passage, said valve means including a valving member located in said bore having a passage aligned with the second passage to allow material to flow through the second passage, said valving member being movable to a position to block the flow of material through the second passage.

11. The apparatus of claim 1 wherein: said container has walls to withstand the pressure of the air supplied by the air compressor, said means mounted on the cap means having a third passage open to the chamber of the container and the first passage to allow air under pressure to flow into the chamber, said air assisting the movement of material up the tube means.

12. The apparatus of claim 11 including: an applicator tube assembly mounted on the nozzle means to carry the air and material toward a desired location, said tube assembly having a material discharge end with at least one small air and material discharge opening.

13. The apparatus of claim 12 wherein: said tube assembly has a flexible portion whereby the nozzle means and container can be moved relative to the discharge end of the tube assembly.

14. The apparatus of claim 1 wherein: said nozzle means has a body with a threaded bore extended through the body for connecting the valve assembly to the body, a coupling mounted on the body with an end portion thereof threaded into said bore, said coupling having a passage and a port connecting the coupling passage with the second passage, said coupling being removeable from said body whereby a coupling with a selected size coupling passage can be mounted on the body, said material being mixed with the air and directed to a selected location, and transverse cylindrical valve means operatively associated with the said nozzle means for selectively allowing material to flow through the second passage into the first passage and stop the flow of material through the second passage.

15. The apparatus of claim 14 wherein: the means for accommodating the container of the dispensing means comprises an opening in the top wall for the container, said container extended through the opening and supported on the base.

16. The apparatus of claim 15 wherein: said top wall has a second opening for accommodating a second container.

17. The apparatus of claim 14 wherein: said container has walls to withstand the pressure of air supplied to the nozzle means, said nozzle means having a third passage open to the chamber of the container and the first passage to allow air under pressure to flow into the chamber, air assisting the movement of material up the tube means.

18. The apparatus of claim 17 including an applicator tube assembly mounted on the nozzle means to carry the air and material toward a desired location, said tube assembly having a material discharge end with at least one small air and material discharge opening.

19. The apparatus of claim 18 wherein: said tube assembly has a flexible portion whereby the nozzle means and container can be moved relative to the discharge end of the tube assembly.

20. The apparatus of claim 1 wherein: said nozzle means has an upright body having a bore extended through the body with an air inlet end and an air and material outlet end, said body being internally threaded through said bore between the inlet and outlet ends thereof, a coupling having a threaded end portion threaded into the air inlet end of said coupling having an enlarged diameter portion adjacent the threaded end portion, the enlarged diameter portion having an inner face engageable with the body to limit the inward movement of the coupling into a predetermined position in the bore, lock means mounted on the body engageable with the coupling to hold the coupling in the predetermined position on the body, said coupling having a passage for carrying air under pressure, said end portion of the coupling having a throat passage and outlet passage downstream of the throat passage aligned with the coupling passage to carry air through the coupling, said body having a passage normal to said coupling passage for carrying material to the outlet passage, said coupling having a port open to the body passage and outlet passage whereby material flows through the body passage into the outlet passage, said material being mixed with air flowing through the outlet passage and discharged to a selective location.

21. The nozzle assembly of claim 20 wherein: said valve means is mounted on the body operable to control the flow of material through the body passage.

22. The nozzle assembly of claim 20 wherein: said body has a body bore intersecting the second passage, a valving member located in said second bore, said valving member having a passage aligned with the body passage to allow material to flow through the outlet passage for carrying material to the outlet passage, said material being mixed with air flowing through the outlet passage and discharged to a selective location, said valving member being moved to a position to close said body passage.

23. The nozzle assembly of claim 20 including: sleeve means threaded into the outlet end of said bore adjacent the end portion of the coupling, said sleeve means having an air and material discharge passage for carrying the air and material toward the selected location.

24. The nozzle assembly of claim 20 including: and applicator tube means mounted on the body to carry air and material from the outlet passage toward a desired location, said tube means having sleeve means threaded into the outlet end of said bore, a material discharge end, and a flexible sleeve portion connecting the sleeve means with the discharge end whereby the body and coupling can be moved relative too the discharge end of the tube means.

* * * * *